United States Patent [19]

Hoes et al.

[11] Patent Number: 4,892,149

[45] Date of Patent: Jan. 9, 1990

[54] METHOD OF SECURING A TUBULAR MEMBER WITHIN AN ANNULAR WELL MEMBER, THE COMBINED WELL STRUCTURE AND THE TOOL

[75] Inventors: Larry M. Hoes, Spring; Thomas G. Cassity, Katy; Steven D. Gullion, Houston, all of Tex.

[73] Assignee: Cameron Iron Works USA, Inc., Houston, Tex.

[21] Appl. No.: 217,376

[22] Filed: Jul. 11, 1988

Related U.S. Application Data

[63] Continuation of Ser. No. 44,409, Apr. 30, 1987, abandoned.

[51] Int. Cl.[4] ..... E21B 33/04

[52] U.S. Cl. ..... 166/379; 29/523; 166/208; 166/380; 285/140; 285/382.5

[58] Field of Search ..... 166/379, 380, 206, 207, 166/208; 285/140–143, 382.5; 29/523

[56] References Cited

U.S. PATENT DOCUMENTS

| | | | |
|---|---|---|---|
| 2,134,311 | 10/1938 | Minor et al. | 166/379 |
| 3,191,677 | 6/1965 | Kinley | 166/207 X |
| 3,434,194 | 3/1969 | Whittaker et al. | 29/523 X |
| 3,712,376 | 1/1973 | Owen et al. | 166/380 X |
| 4,388,752 | 6/1983 | Vineiguerra et al. | 29/523 X |
| 4,485,547 | 12/1984 | Busse | 29/523 |
| 4,648,626 | 3/1987 | Vincignerra et al. | 29/523 X |
| 4,662,663 | 5/1987 | Schmitz | 285/382.5 |

*Primary Examiner*—Hoang C. Dang

[57] ABSTRACT

The present invention relates to an improved well structure and the method of connecting the support ring to the well string within the well bore which includes the steps of lowering the support ring into the well bore in surrounding relationship to the well string and into seated position in the housing seat, lowering a pressure forming tool through the well string to the level of the support ring, pressurizing the tool to form the well string into tight secured and sealed relationship within the support ring and recovering the tool from the well string. The tool includes a means of increasing the pressure used in the forming process without subjecting the interior of the string along its full length to such forming pressure. The structure includes a support ring with an exterior shoulder for engaging the seat within the housing, a sealing profile of a plurality of internal grooves each of which is partially filled with pressure compensating material and a gripping profile of a plurality of gripping teeth. The improved well structure includes the support ring and a tubular element within the support ring deformed into tight gripping and sealing engagement with the interior of the support ring.

9 Claims, 7 Drawing Sheets

METHOD OF SECURING A TUBULAR MEMBER WITHIN AN ANNULAR WELL MEMBER, THE COMBINED WELL STRUCTURE AND THE TOOL

This is a continuation of Ser. No. 44,409, filed Apr. 30, 1987, now abandoned.

BACKGROUND

Hangers in well bores are used to seat within a housing within the well bore and to engage a string to provide a seating for the string. Some hangers have utilized slips to engage and support the well string. U.S. Pat. Nos. 2,920,909 and 3,311,168.

Other hangers have had an external shoulder which is adapted to seat on an internal housing seat, such as is shown in U.S. Pat. Nos. 3,561,527 and 3,797,864.

Such hangers are provided normally with external threads on their lower ends and have their well strings threaded thereon.

In the past it has been known that a portion of a remote connector could be remotely cold formed onto the end of a subsea pipeline so that a repair section could be connected to the existing pipeline. Examples of cold forming are shown in U.S. Pat. Nos. 3,432,916; 4,330,144; and 4,388,752. U.S. Pat. No. 4,662,663 suggests the use of a material within the grooves to compensate for any build-up of pressure therein during forming.

SUMMARY

The present invention relates to an improved well structure and the method of connecting the improved support ring to the well string within the well bore which includes the steps of lowering the support ring into the well bore into surrounding relationship to the well string and onto seated position in the housing seat, lowering a pressure forming tool through the well string to the level of the support ring, pressurizing the tool to form the well string into tight secured and sealed relationship within the support ring, testing the new connection and recovering the tool from the well string. The tool includes a means of amplifying the pressure used in the forming process without subjecting the interior of the string along its full length to such forming pressure. The improved support ring includes an exterior shoulder for engaging the seat within the housing, a sealing profile of a plurality of internal grooves each of which is partially filled with pressure compensating material and a gripping profile of a plurality of gripping teeth. The improved well structure includes the support ring and a second element having a tubular portion which is deformed into tight gripping and sealing engagement with the interior of the support ring.

An object of the present invention is to provide an improved method of securing a well string to a support ring within a well bore.

Another object is to provide an improved well hanger which is simply and permanently secured to a well string within a well bore.

A further object is to provide an improved remote forming tool for securing a string into a surrounding ring.

Still another object is to provide an improved method of connecting two annular members to each other within a well bore.

BRIEF DESCRIPTION OF THE DRAWINGS

These and other objects and advantages are hereinafter set forth and explained with respect to the drawings wherein.

DESCRIPTION OF THE PREFERRED EMBODIMENTS

Figure 1:
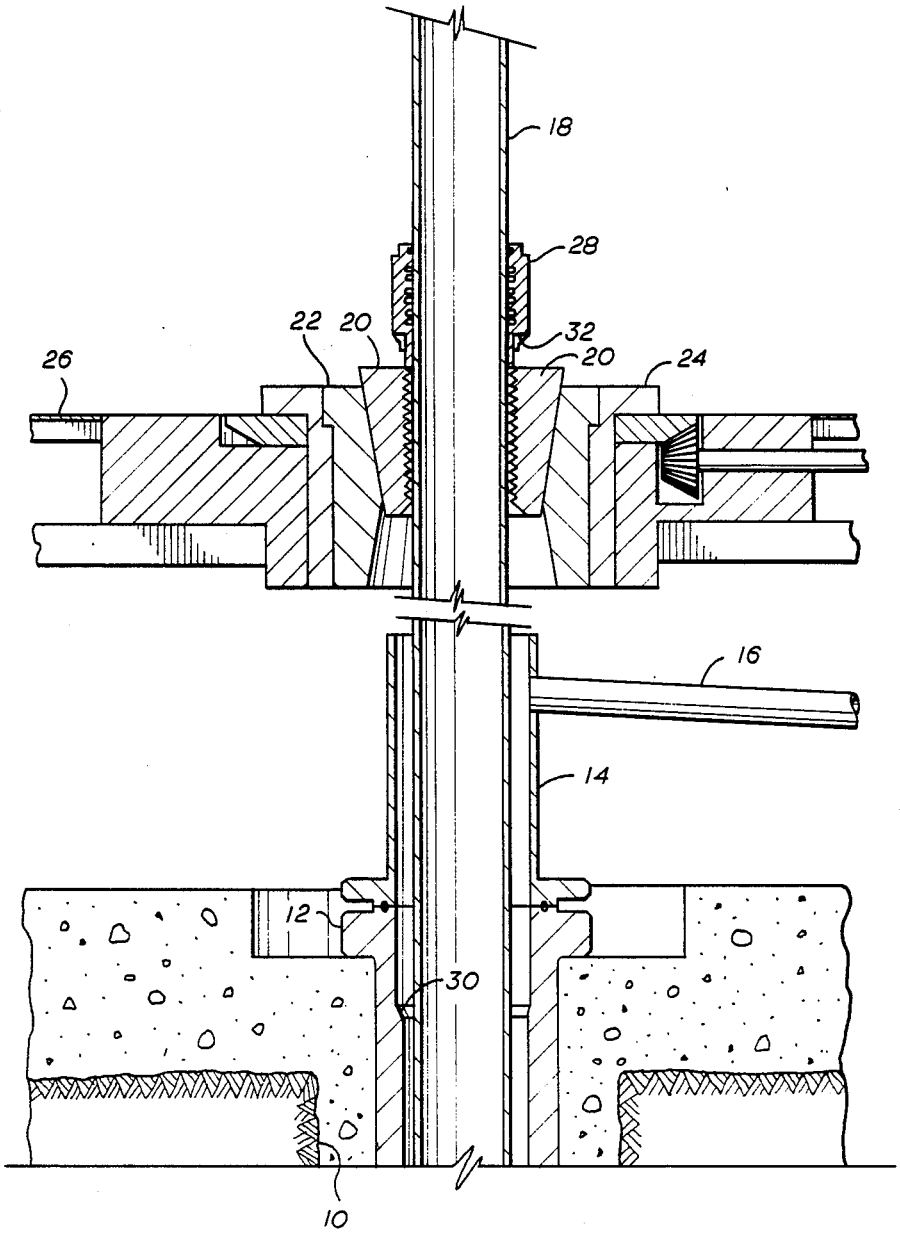
FIG. 1 is a schematic sectional view of a well bore with a well string supported in the rotary table with the support ring surrounding the string above the rotary table.
Figure 2:
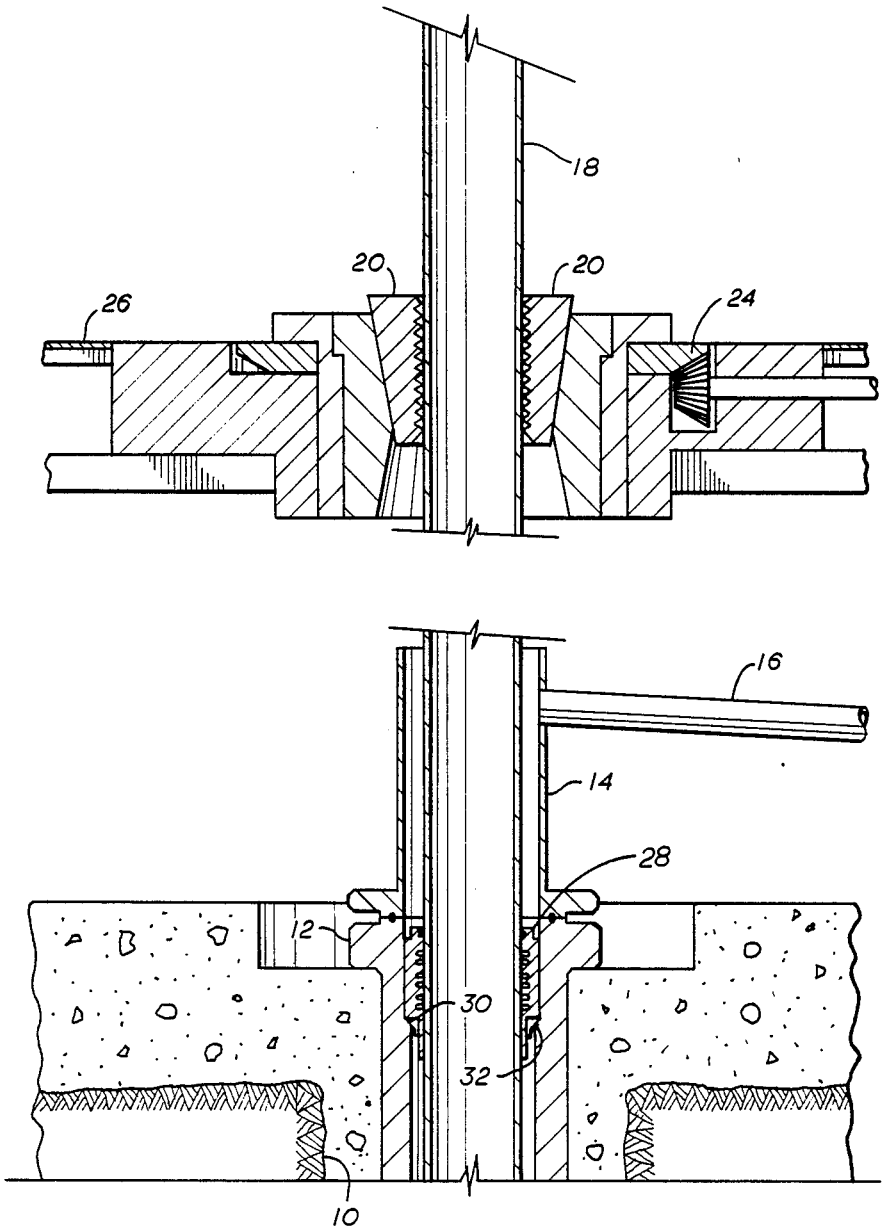
FIG. 2 is another schematic sectional view of the well bore with the support ring landed on the housing seat.

Well bore 10 is shown in FIG. 1 with wellhead housing 12 cemented therein and with bell nipple 14 extending upward therefrom for conducting returns from the annulus to the return line 16. Casing string 18 is supported by slips 20 in bowl 22 supported in rotary table 24 in rig floor 26. After string 18 has been cemented it is supported in this manner and disconnected above slips 20 so that seat ring 28 can be positioned in surrounding relation to string 18 immediately above slips 20. Casing string 18 is then supported above rig the floor 26 by the derrick (not shown) and weight is taken by lifting casing string 18 to remove slips 20 and lowering seat ring 28 on a soft line until it is landed with its landing shoulder 32 on landing seat 30 within wellhead housing 12. After seat ring 28 is landed, casing string 18 is again tensioned and slips 20 are again set to support the string in tension as shown in FIG. 2. It should be recognized that in some instances it may be desirable to have a blowout preventer stack installed between the top of wellhead housing 12 and the bottom of bell nipple 14 to control any possible pressure build up, due to the reservoir formation.

Figure 3:
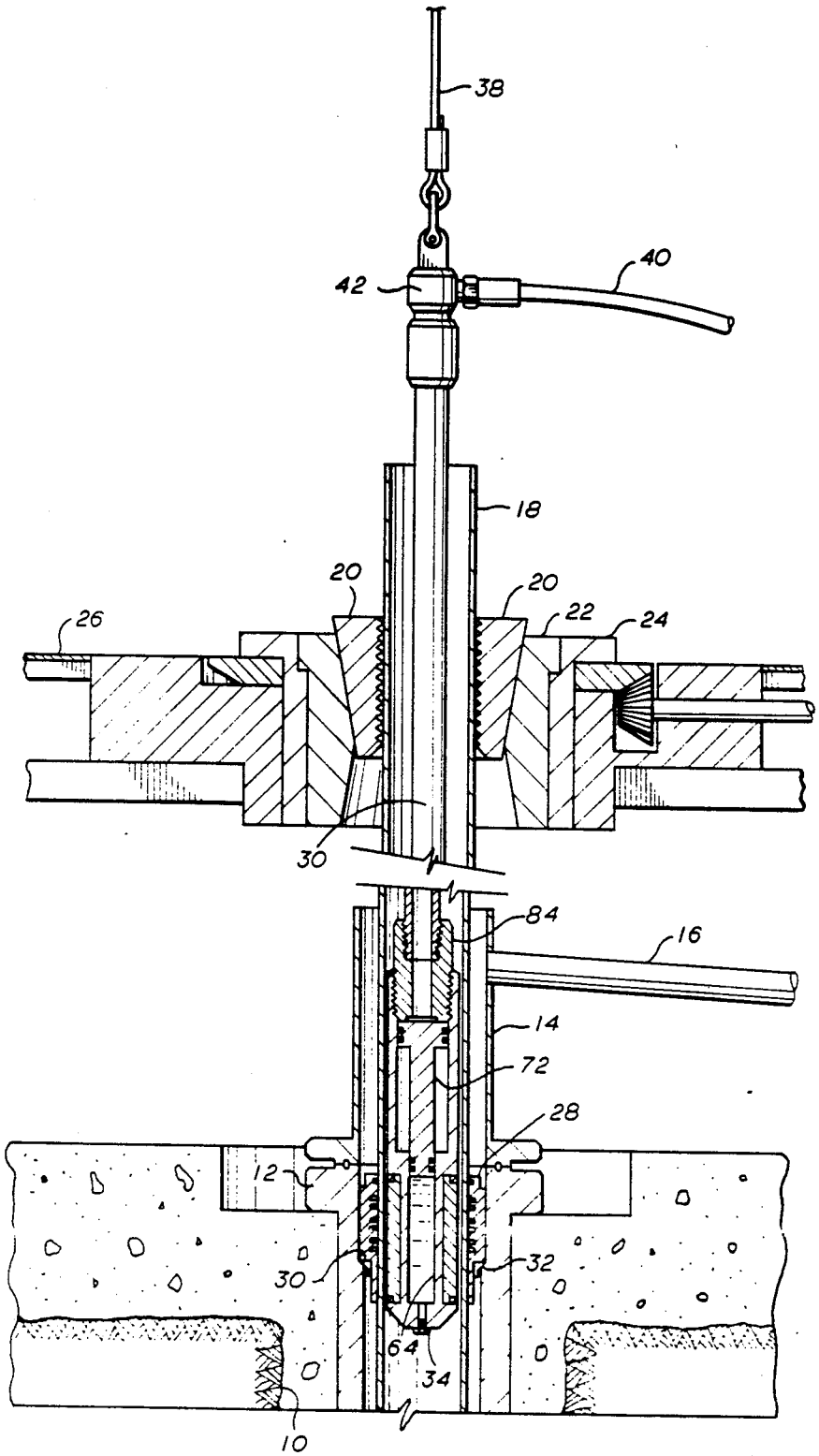
FIG. 3 is another schematic sectional view of the well bore with the forming tool positioned within the well string at the level of the support ring.
Figure 4:
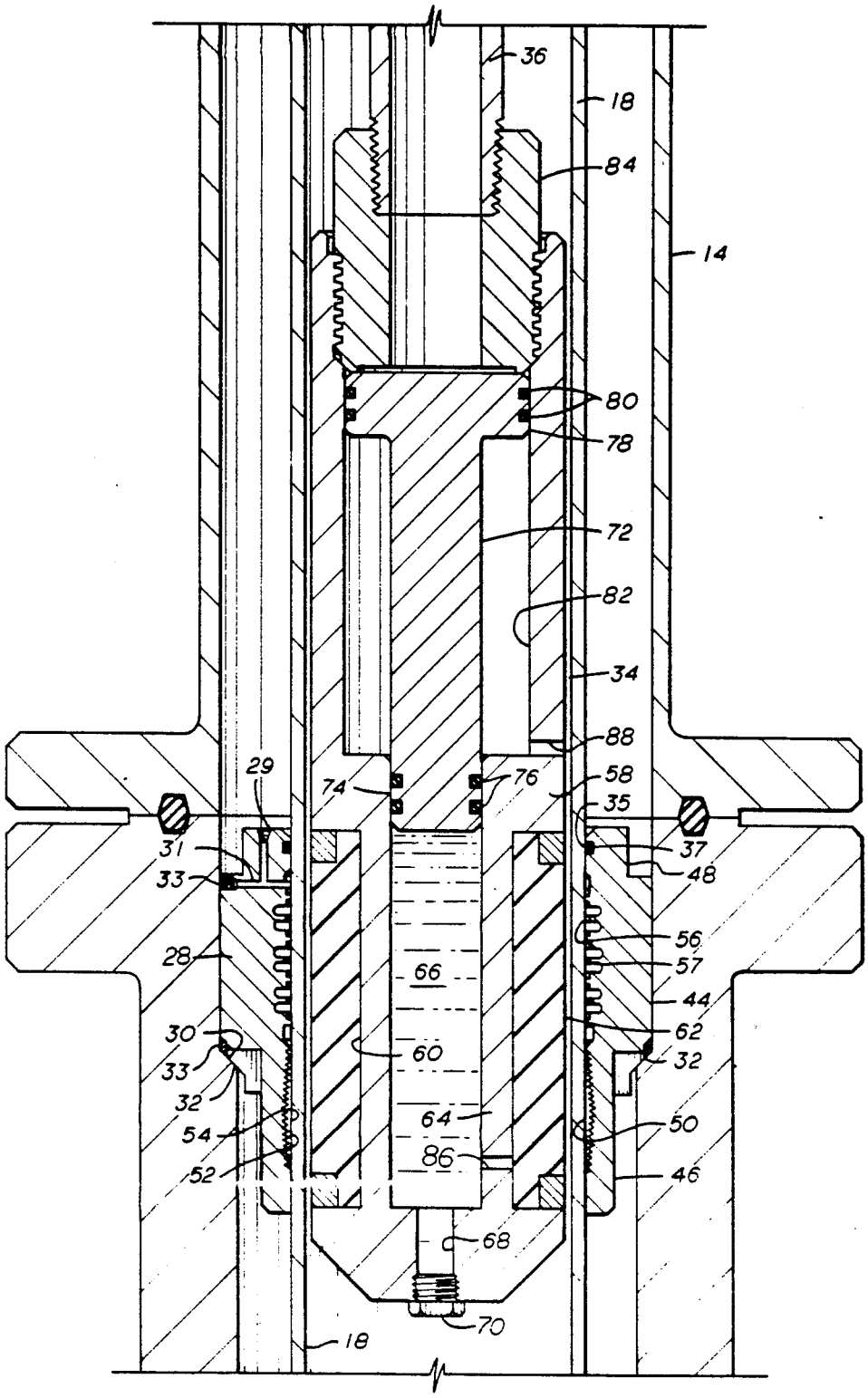
FIG. 4 is a detail sectional view of the portion of FIG. 3 to show the structure of the support ring, the well string and the forming tool prior to the forming step.

The portion of casing string 18 above slips 20 is disconnected and forming tool 34 is lowered on drill string 36 through the interior of casing string 18 until the lower end of forming tool 34 is immediately within seat ring 28 but on the interior of casing string 18. This position of forming tool 34 is shown in FIGS. 3 and 4. String 36 is supported by line 38 and includes fluid line 40 connecting to the interior of string 36 through fitting 42.

As shown in FIG. 4, seat ring 28 includes central body 44 with landing shoulder 30 on the lower exterior thereof, lower tubular extension 46 and upper tubular extension 48. The interior of lower tubular extension 46 includes annular concavity 50 having internal grooves 52 with sharp projections 54 which may be created by threading or other suitable machining. The interior of central body 44 includes a plurality of grooves 56 which are at least partially filled with a pressure compensating material 57, such as microspheres suspended in an epoxy matrix. The inner diameter of seat ring 28 is just sufficiently larger than the outer diameter of casing string 18 so that seat ring 28 can be lowered into position as hereinbefore described. It is preferred that landing shoulder 32 be formed on separate landing ring 31' rather than being integral with seat ring 28. As shown in FIG. 4, soft metal seal ring 33 is mounted on the lower exterior surface of seat ring 28 to seal the annular space between the outer diameter of seat ring 28 and the inner diameter of wellhead housing 12.

Forming tool 34 includes tubular body 58 which is closed at its lower end, includes annular recess 60 in which resilient annular packing 62 is positioned. Bore 64 forming the interior of body 58 within packing 62 is filled with suitable hydraulic fluid 66. Such filling is accomplished through opening 68 which is closed by plug 70 threaded into opening 68. Piston 72 is positioned within forming tool 34 and includes lower end 74 surrounded by seals 76 which are positioned within the upper end of bore 64 and its upper end 78 which is substantially larger than lower end 74 is surrounded by seals 80 and is within counterbore 82. Ring 84 is threaded into the upper end of forming tool 34 and forms the stop for the upper limit of movement of piston 72. Ring 84 has upper internal threads into which string 36 is connected to both support tool 34 and provide a conduit for the delivery of fluid under pressure thereto.

With forming tool 34 positioned as shown in FIG. 4, fluid under pressure is delivered through fluid line 40, fitting 42 and string 36 into the upper end of counterbore 82 so that the upper end of piston 72 is exposed to such pressure. The area of the upper end of piston 72 being substantially larger than the area of the lower end of piston 72 creates a substantially greater pressure within bore 64 than the pressure delivered through fluid line 40. Thus in this way, piston 72 functions as an amplifier of the fluid pressure delivered to tool 34 by string 36. The hydraulic fluid within bore 64 is also conducted through port 86 which extends through body 58 into communication with recess 60 and the interior of resilient annular packing 62. As sufficient hydraulic pressure is developed within packer 62, packer 62 is expanded radially outward against the interior of casing 18 and sufficient force is developed to force casing 18 into grooves 56 and into annular concavity 50 into tight gripping engagement with sharp projections 54 between internal grooves 56. The engagement of casing 18 within annular concavity 50 functions to secure casing 18 within seat ring 28 and the engagement of casing 18 within internal grooves 56 functions to seal seat ring 28 to the exterior of casing 18. During the movement of piston 72, port 88 which extends through body 58 from the lower portion of counterbore 82 to the exterior of body 58 provides venting of fluids within counterbore 82 to prevent hydraulic locking of piston 72. Seat ring 28 includes internally threaded test port 29 which intersects radial port 31 which goes from the exterior diameter of seat ring 28 to the interior diameter of seat ring 28. Recessed pipe plug 33' closes port 31 where it intersects the outer diameter of seat ring 28. Seat ring 28 also includes interior O ring seal 35 positioned in groove 37 which is located immediately above radial port 31 which is located above grooves 56. By introducing test pressure through ports 29 and 31 into the annular space above grooves 56 and below O ring 35, the seal formed between casing 18 and grooves 56 can be tested to determine if sufficient forming force has been used prior to removal of forming tool 34.

Figure 5:
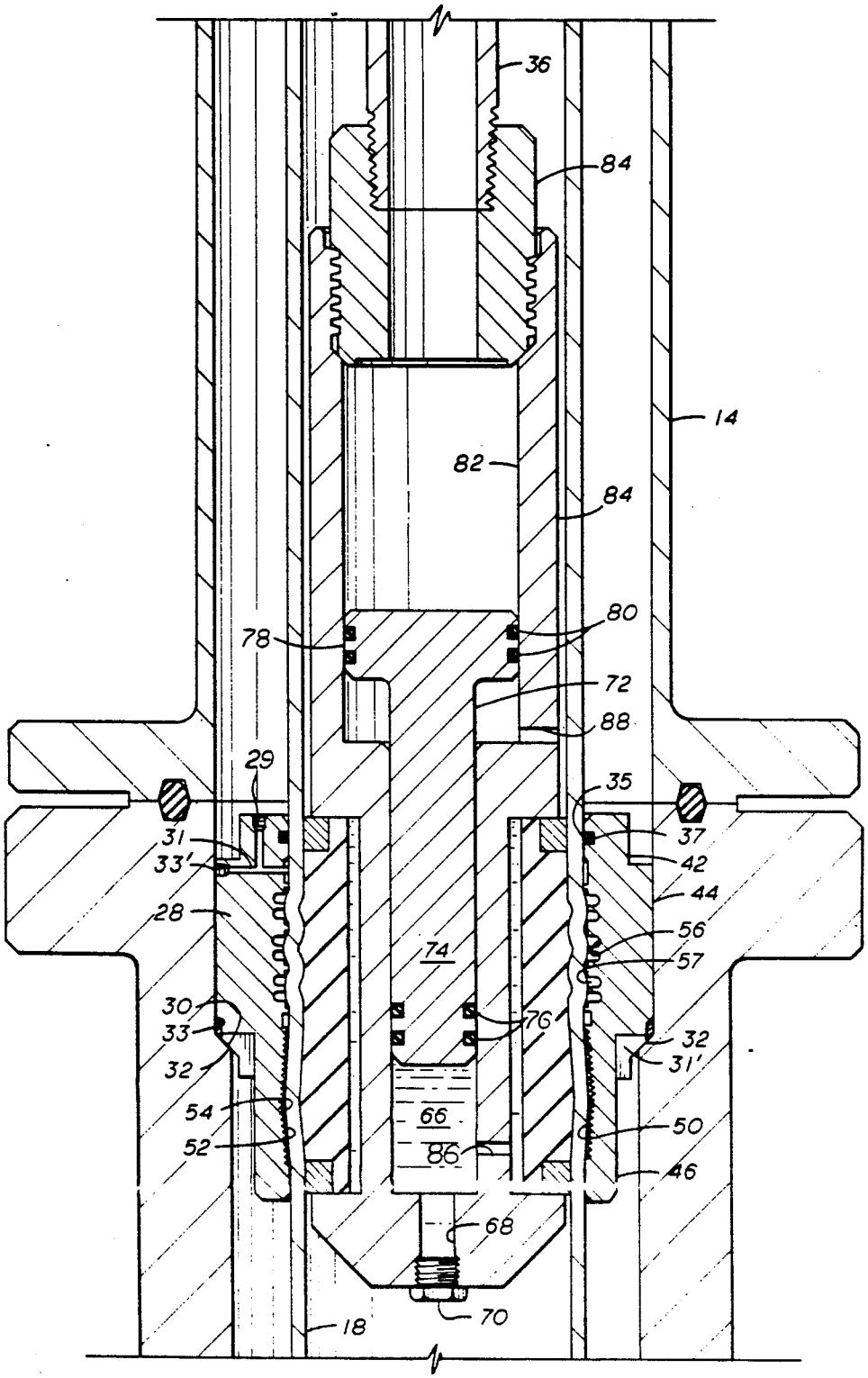
FIG. 5 is a detail sectional view similar to FIG. 4 but illustrating the completion of the forming of the well string into the support ring.
Figure 6:
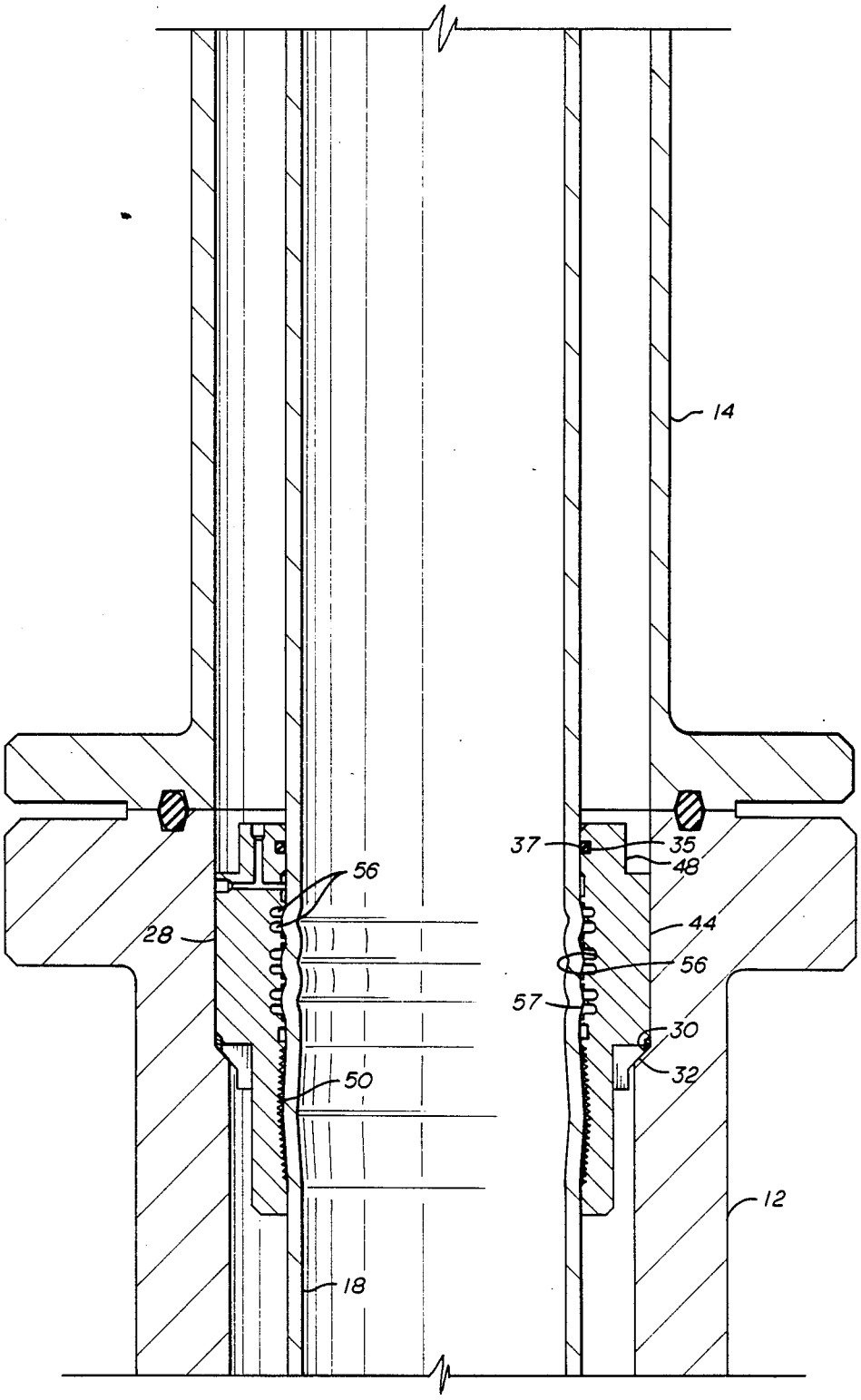
FIG. 6 is a schematic sectional view of the well bore with the well string secured to the support ring and the forming tool removed therefrom.

The use of pressure compensation material 57 within internal grooves 56 allows the forming of casing even when the total structure is in a liquid environment, such as underwater in a subsea location, and prevents the liquid from forming a hydraulic lock or barrier to such formation of casing 18. FIG. 5 illustrates the completion of the forming of casing 18 with tool 34 still positioned within casing in its forming position. FIG. 6 illustrates the completion of the forming with forming tool 34 removed from within casing 18 and casing 18 is shown deformed into a gripping and sealing engagement with the interior of seat ring 28.

Figure 7:
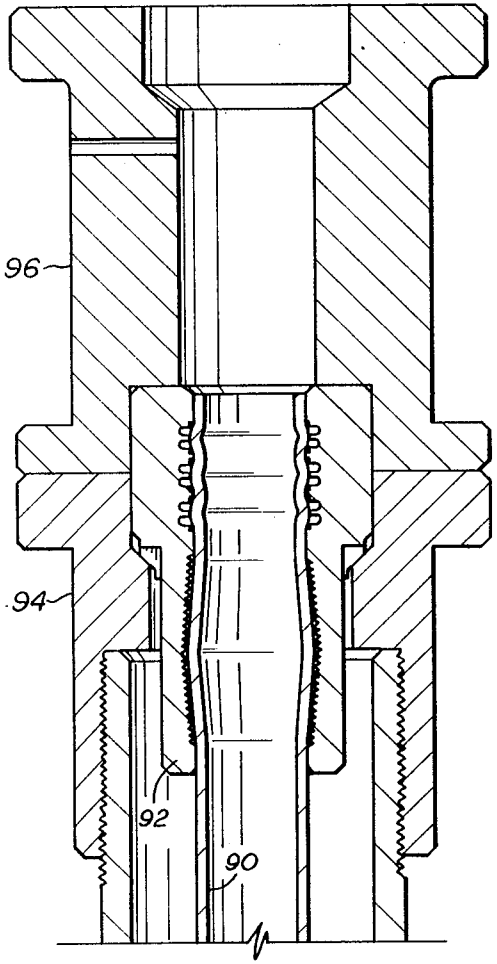
FIG. 7 is a detail sectional view of a modified form support ring having a well string formed therein according to the improved method of the present invention.

A modified form of the apparatus of the present invention is illustrated in FIG. 7 which shows string 90 which has been deformed by the method of the present invention into tight gripping and sealing engagement within hanger 92 which is seated within a well housing 94. Spool 96 is landed on housing 92 above hanger 92.

Figure 8:
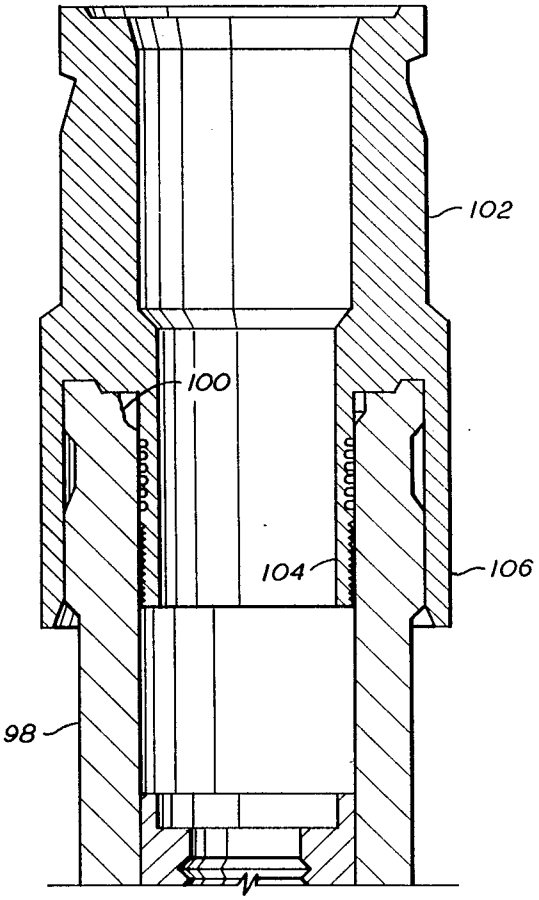
FIG. 8 is another detail sectional view of another modified form of two well structures being combined by the improved method of the present invention to repair a damaged well member.

Another modified form of the apparatus of the present invention is illustrated in FIG. 8 which illustrates well housing 98 which has a damaged upper internal shoulder 100. Repair housing 102 is provided with the desired internal, external and upper profile and includes inner rim 104 extending downward within housing 98 and outer rim 106 which extends downward on the exterior of housing 98. Inner rim 104 is deformed by the improved method of the present invention into tight gripping and sealing engagement with the interior of housing 98.

What is claimed is:

1. A method of securing a first annular member to a second annular member in a well including the steps of positioning said members in the wall with one of said members being in surrounding relationship to the other of said members, lowering a forming tool to a position within the inner of said members at a level at which such members are to be joined, delivering fluid pressure to the forming tool at its position within the members and at a pressure sufficiently high to cause a portion of the inner member to be deformed by the forming tool radially outward into tight sealing and gripping engagement with the outer member, relieving pressure delivered to the forming tool following completion of the deformation of the inner member, delivering testing pressure to the outer of said members, providing a seal between the two members at a position above the deformed portion of the inner member, conducting testing pressure through the outer member to a position between said members above the deformed portion of the inner member and below the seal between the two members, and detecting loss of test pressure delivered to said outer member.

2. A method according to claim 1 including the step of retrieving the forming tool from said well.

3. The method according to claim 1 including the step of retrieving the running string and the forming tool from the well after the completion of the testing step.

4. The method of securing a well string to a seat ring in a well, including the steps of lowering a seat ring in surrounding relationship to a string into the well and into landed position on a well housing landing seat within the well, supporting the string at a desired position with respect to said seat ring, lowering a forming tool into the string after the seat ring has been landed and said string is supported, positioning the forming tool at a position within the string immediately within the seat ring, delivering fluid pressure through the string to the forming tool at a pressure sufficiently high to cause the string immediately within the seat ring to be deformed by the forming tool radially outward into tight sealing and gripping engagement with said seat ring, relieving fluid pressure from the forming tool, recovering the forming tool from within the string, and pressure testing the seal between the string and the seat ring by delivering testing pressure through the seat ring to a position at the upper end of the formed engagement between the string and seat ring and below a resilient seal positioned for sealing between the string and the seat ring and detecting any loss of pressure delivered to the seat ring.

5. A well structure comprising a first annular member, a second annular member, said annular members being positioned within a well with at least a portion of one of said members being in surrounding relationship to at least a portion of the other of said tubular members, the inner of said annular members being deformed radially outward into tight gripping and sealing engagement with the outer of said annular members, a resilient seal between said annular members positioned above the deformed portion of said inner annular member, a passage through the outer annular member communicating to its interior surface at a point between the deformed portion of the inner annular member and said resilient seal, and means for delivering fluid under pressure to said passage for testing the effectiveness of the sealing engagement between said inner and outer annular members.

6. A well structure according to claim 5 wherein said annular members include a casing string, and a seat ring surrounding the casing string.

7. A well structure comprising a string extending vertically within a well bore at a level of a landing surface within the well bore, a seat ring surrounding said string and landed on the landing surface within the well bore, said string being deformed radially outward within said seat ring, said seat ring having an internal grooved profile for receiving the exterior of said string during its deformation in tight gripping and sealing engagement therewith and an interior surface above said grooved profile, a resilient seal between the seat ring and the string on the upper interior surface of the seat ring for sealing against said string after its deformation, and a passage through said seat ring communicating to its interior surface at a position between said resilient seal and said grooved profile whereby test pressure may be delivered through such passage following completion of deformation of said string to test the effectiveness of the seal of the string against said internal grooved profile.

8. A method of securing a first annular member to a second annular member in a well including the steps of positioning said members in the well with one of said members being in surrounding relationship to the other of said members, lowering a forming tool to a position within the inner of said members at a level at which such members are to be joined, delivering fluid pressure to the forming tool at its position within the members and at a pressure sufficiently high to cause a portion of the inner member to be deformed by the forming tool radially outward into tight sealing and gripping engagement with the outer member, relieving pressure delivered to the forming tool following completion of the deformation of the inner member, delivering testing pressure to the outer of said members, providing a seal against the inner surface of the outer annular member at a position above the deformed portion of the inner member, conducting testing pressure through the outer member to a position between said members above the deformed portion of the inner member and below the seal, and detecting loss of test pressure delivered to said outer member.

9. A well structure comprising a first annular member, a second annular member, said annular members being positioned within a well with at least a portion of one of said members being in surrounding relationship to a least a portion of the other of said tubular members, the inner of said annular members being deformed radially outward into tight gripping and sealing engagement with the outer of said annular members, a resilient seal above the deformed portion of said annular member for sealing against the interior of said outer annular member to prevent pressure from leaking to a position above said resilient seal, a passage through the outer annular member communicating to its interior surface at a point between the deformed portion of the inner annular member and said resilient seal, and means for delivering fluid under pressure to said passage for testing the effectiveness of the sealing engagement between said inner and outer annular members.

* * * * *